US011130331B2

(12) United States Patent
Kilde et al.

(10) Patent No.: US 11,130,331 B2
(45) **Date of Patent: *Sep. 28, 2021**

(54) PRINTING APPARATUS

(71) Applicants: BALL BEVERAGE PACKAGING EUROPE LIMITED, Luton (GB); BALL BEVERAGE CAN SOUTH AMERICA S.A., Rio de Janeiro (BR)

(72) Inventors: Henrik Kilde, Fredericia (DK); Michael Bo Hansen, Fredericia (DK); Bruno Leonardo Giublin, São José dos Campos (BR); Leandro Augusto Guilherme, São José dos Campos (BR)

(73) Assignees: BALL BEVERAGE PACKAGING EUROPE LIMITED, Luton (GB); BALL BEVERAGE CAN SOUTH AMERICA S.A., Rio de Janeiro (BR)

( * ) Notice: Subject to any disclaimer, the term of this patent is extended or adjusted under 35 U.S.C. 154(b) by 0 days.

This patent is subject to a terminal disclaimer.

(21) Appl. No.: 16/895,130

(22) Filed: Jun. 8, 2020

(65) Prior Publication Data

US 2020/0298552 A1 Sep. 24, 2020

Related U.S. Application Data

(63) Continuation of application No. 15/532,625, filed as application No. PCT/GB2015/053725 on Dec. 4, 2015, now Pat. No. 10,675,861.

(30) Foreign Application Priority Data

Dec. 4, 2014 (EP) ..... 14196388

(51) Int. Cl.
*B41F 17/22* (2006.01)
*B41M 1/40* (2006.01)
(Continued)

(52) U.S. Cl.
CPC ..... *B41F 33/0081* (2013.01); *B41F 13/14* (2013.01); *B41F 17/22* (2013.01);
(Continued)

(58) Field of Classification Search
CPC ..... B41F 17/22; G01N 21/8851; G01N 21/9036; G01N 21/9045; B21D 51/2692; B21D 51/2646; B41M 1/40
(Continued)

(56) References Cited

U.S. PATENT DOCUMENTS 6,408,748 B1 6/2002 Hajek et al.
2012/0216689 A1* 8/2012 Cochran ..... B41F 33/02 101/39

FOREIGN PATENT DOCUMENTS

EP 3028856 B1 6/2016
WO 2007051660 A1 5/2007

OTHER PUBLICATIONS

Mexican Office Action for corresponding Mexican Patent Application No. MX/a/2017/007140 dated Feb. 8, 2021.

* cited by examiner

*Primary Examiner* — Leslie J Evanisko
(74) *Attorney, Agent, or Firm* — Greer, Burns & Crain, Ltd.

(57) ABSTRACT

According to the invention there is an apparatus for printing onto cylindrical structures comprising: a plurality of inker devices each comprising a print cylinder and one or more servomotors for adjustably controlling the position or orientation of a print cylinder; a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon; a
(Continued)

transporter for transporting the cylindrical structures into and out of contact with the print blankets; and an automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device.

20 Claims, 4 Drawing Sheets

(51) Int. Cl.
*B41F 33/00* (2006.01)
*B41F 13/14* (2006.01)
*B41F 27/00* (2006.01)
*B41M 1/06* (2006.01)

(52) U.S. Cl.
CPC ..... *B41F 27/00* (2013.01); *B41M 1/06* (2013.01); *B41M 1/40* (2013.01)

(58) Field of Classification Search
USPC ..... 101/38.1, 39, 40
See application file for complete search history.

300

PRINTING APPARATUS

CROSS-REFERENCE TO RELATED APPLICATIONS

This application is a continuation of U.S. application Ser. No. 15/532,625, now U.S. Pat. No. 10,675,861, filed on Jun. 2, 2017, which was national stage filing under 35 U.S.C. § 371 of PCT/GB2015/053725, which was filed on Dec. 4, 2015, and claimed priority to European Patent Application No. 14196388.4, which was filed on Dec. 4, 2014.

FEDERALLY SPONSORED RESEARCH OR DEVELOPMENT

N/A

TECHNICAL FIELD

This invention relates to apparatus for printing onto cylindrical structures and to associated methods of printing onto cylindrical structures.

BACKGROUND

In the field of industrial can manufacture, it is typical that the finished product requires some form of decoration in the form of printed indicia. Specialist printing machines are known to provide continuous, mass printing onto cans at a high throughput. These printing machines are commonly known as "decorators" in the art. At the present time, there are two main decorator designs which are in common commercial use, although there are additional, smaller volume manufacturers as well. The two main designs are commonly known as the "Concord" and "Rutherford" machines. Although the precise constructional details of the Concord and Rutherford machines differ, in essence they use the same approach to printing onto cans. This approach is a variant of offset printing. More specifically, the decorators comprise a plurality of inkers. Each inker is associated with a different color, and has a printing plate for that color. Each inker is configured to distribute ink of the correct color onto the printing plate. The printing plate has a raised portion corresponding to the desired image for the particular color in question. It will be apparent that, for example, a six inker decorator machine can print six colors, and an eight inker decorating machine can print eight colors. The ink from the print plate of each inker is transferred onto the surface of one of a number of blankets. The intention is that the blanket and the print cylinders of all of the inkers are mutually positioned and oriented such that the different colored inks are in proper registration. When proper registration is achieved, the pattern of multiply colored inks on the blanket corresponds to the desired indicia. The decorator machines comprise a plurality of blankets which are disposed on a rotating blanket wheel. As the wheel rotates, a blanket which has had all of the inks transferred to it in the desired pattern is brought into contact with a suitable conveyor system which typically uses a number of mandrels on a mandrel wheel. The decorator machine is configured so that each can is brought into contact with a blanket so that the full multicolored indicia is transferred to the surface of the can.

It is inevitable that during a continuous can printing process, some misregistration of one or more of the colors will occur. Traditionally, misregistration problems have been corrected manually. More specifically, any misregistration is detected by manual inspection of the printed cans.

If a misregistration is identified, then it has been necessary to shut down printing for a period of time whilst manual adjustments of the inkers are made. This is an inefficient process for at least two reasons. Firstly, there is a time lag before a misregistration is identified which can result in can spoilage. Secondly, it is inefficient and undesirable to shut down a continuous process for any period of time.

The present invention, in at least some of its embodiments, addresses the above described problems. Additionally, the present invention provides improved arrangements for controlling the position of the print cylinders.

SUMMARY

According to a first aspect of the invention there is provided apparatus for printing onto cylindrical structures comprising:

a plurality of inker devices each comprising a print cylinder and one or more servomotors for adjustably controlling the position or orientation of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon;

a transporter for transporting cylindrical structures into and out of contact with the print blanket; and an automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device.

In this way, the above described problems can be solved. In particular, detection of misregistrations can take place quickly. Also, misregistrations can be corrected without stopping the printing process.

The print detection device may inspect the print blankets to detect a misregistration.

Alternatively, the print detection device may inspect the printed cylindrical structures to detect a misregistration. Alternatively still, the print detection device may inspect the print cylinders to detect a misregistration.

The print detection device may comprise a camera. The print detection device may comprise a single camera, or a plurality of cameras.

The print cylinders may each have a longitudinal adjustment servomotor. The longitudinal adjustment servomotor may adjustably control the longitudinal position of its respective print cylinder. The longitudinal adjustment servomotors may be controlled by the controller. The print cylinders may be each connected to their respective longitudinal adjustment servomotor through a print shaft. At least a portion of the print shaft may be movable by the longitudinal adjustment servomotor so as to adjustably control the longitudinal position of its respective print cylinder. The print shafts may each comprise an outer shaft member and an inner shaft member. The inner shaft member may be reciprocable within the outer shaft member. The inner shaft member may be connected to its respective longitudinal adjustment servomotor and print cylinder so that the longitudinal adjustment servomotor can adjust the longitudinal position of the print cylinder by moving the inner shaft member. In practice, commercial decorator apparatus are configured so that the longitudinal direction is in the vertical, and a longitudinal adjustment alters the vertical position of a print cylinder.

The print cylinders may each have an angular adjustment servomotor. The angular adjustment servomotors may adjustably control the angular orientation of their respective print cylinders about a rotational axis. The angular adjustment servomotors may be controlled by the controller.

The apparatus may further comprise a drive mechanism. The print cylinders may each be connected to a print shaft which carries a gear, the gear being driven by the drive mechanism to cause the print cylinder to rotate about the rotational axis. The angular adjustment servomotor may be arranged to alter the operation of the gear so as to adjustably control the angular orientation of its respective print cylinder. The gear may be a backslash gear. The backslash gear carries gear teeth which may be inclined at an angle with respect to the longitudinal axis of the print shaft. The angular adjustment servomotor may adjust the longitudinal position of the backslash gear which in turn results a rotational adjustment of the print cylinder about its rotational axis. In this way, the angular orientation of the print cylinder can be controlled.

The gear may be slideable along the print shaft under the control of angular adjustment servomotor. Each angular adjustment servomotor may be connected to one or more cam followers which follow a cam. The cam may be disposed on the print shaft and form part of or be connected to a hub. A hub may be slideable along the print shaft. The gear may be mounted on the hub. In practice, the rotational axis corresponds to the longitudinal axis of the print cylinder. Commercial decorator apparatus are configured so that the rotational axis is a vertical axis.

The apparatus may print onto cans. The transporter may be configured to transport cans into and out of contact with the print blankets. The transporter may comprise a plurality of mandrels for holding the cans. The cans may be metallic cans, such as aluminum, or maybe formed from another material. The cans may be beverage cans.

Typically, the controller comprises a computer or another device or system which utilizes a microprocessor. The controller may comprise a graphical interface.

The print cylinder may comprise a main portion and a print plate which may be removably attached to the main portion. The print plate may be removably attached to the main portion by magnetic attachment. The print plate may comprise raised features corresponding to a desired print pattern.

Indicia of any desired kind may be printed onto the cans. The indicia may comprise one or more of an image, a design, a logo, or words.

The print cylinder may each print one or more registration indicia onto the print blankets. The print blankets may each comprise one or more corresponding registration features. Misregistration of ink transferred onto a print blanket may be detected by detecting a misregistration between a registration indicia printed by a print cylinder and the corresponding registration feature on a print blanket. The misregistration may be corrected so that a printed registration indicia and its corresponding registration feature overlap, and preferably fully overlap. The registration indicia and registration features may be any convenient shape or symbol. For example, dots, lines or crosses may be used. The registration features may be located towards the edge of the print blankets. The print detection device may be configured to only detect registration indicia and registration features, or at least to monitor only a subset of entire printing field. This can reduce the complexity of the print inspection system.

According to a second aspect of the invention there is provided a method of printing onto cylindrical structures comprising the steps of:

operating a plurality of inker devices to apply ink to a plurality of print cylinders, each inker device having one or more servomotors for adjustable controlling the position or orientation of its print cylinder;

transferring ink from the print cylinders to a print blanket;

transferring ink from the print blanket to a cylindrical structure to achieve printing thereon; and automatically detecting a misregistration of ink transferred from one or more of the print cylinders onto the print blanket and automatically controlling the servomotors of the print cylinders to correct the misregistration in response to the detection of a misregistration.

It is advantageous that both the automatic detection of a misregistration and the automatic control of the servomotors to correct the misregistration can be performed as part of a continuous printing process. In other words, the process does not have to be stopped in order for the misregistration to be corrected.

According to a third aspect of the invention there is provided apparatus for printing onto cylindrical structures comprising:

a plurality of inker devices each comprising a print cylinder, a print shaft connected to the print cylinder, and a servomotor for adjustably controlling the position of the print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon; and a transporter for transporting a cylindrical structure into and out of contact with the print blanket;

in which, in each inker device, the print shaft comprises an outer shaft member and an inner shaft member which is reciprocable within the outer shaft member, and the inner shaft member is connected to the servomotor.

In this way, an extremely convenient and accurate means is provided for adjusting and controlling the position of the print cylinder. The arrangement is space saving, and permits easy maintenance. Additionally, it is convenient to provide a retrofit to an existing decorator apparatus. The third aspect of the invention can be conveniently incorporated into decorators of the Rutherford type. However, the invention is not limited in this regard, and this aspect of the invention can be incorporated into other decorator designs.

Whilst the invention has been described above, it extends to any inventive combination of the features set out above, or in the following description, drawings or claims. For example, any feature described in relation to one aspect of the invention is considered to be disclosed also in relation to another aspect of the invention.

BRIEF DESCRIPTION OF THE DRAWINGS

Embodiments of apparatus and methods in accordance with the invention will now described with reference to the accompanying drawings, in which.

DETAILED DESCRIPTION

Figure 1:
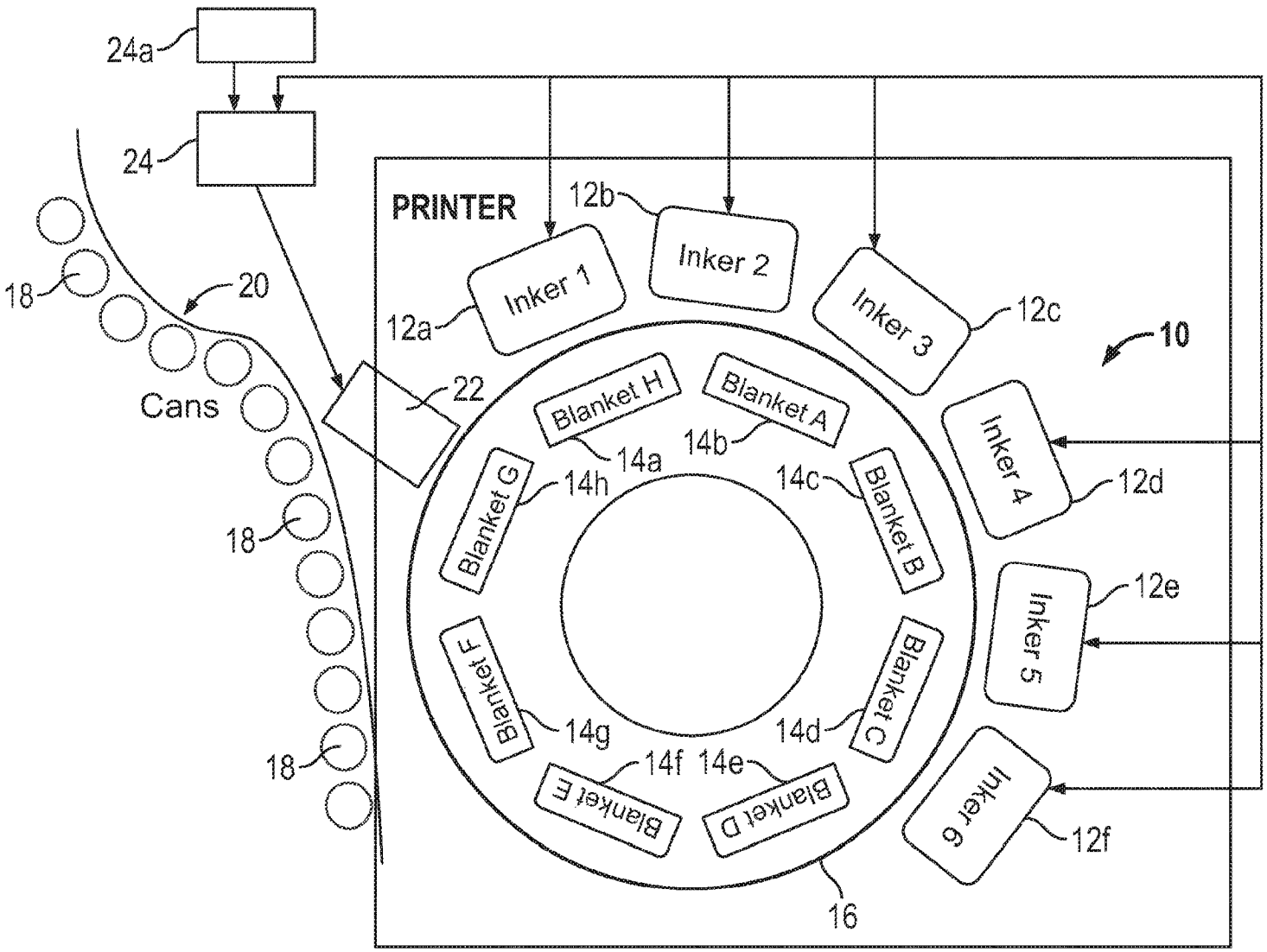
FIG. 1 is a plan view of a decorator apparatus of the invention.

FIG. 1 shows a decorator apparatus of the invention, depicted generally at 10. The decorator apparatus 10 comprises a plurality of inkers 12*a*, 12*b*, 12*c*, 12*d*, 12*e*, 12*f* and plurality of blankets 14*a*, 14*b*, 14*c*, 14*d*, 14*e*, 14*f*, 14*g*, 14*h*. The blankets are disposed on a blanket wheel 16. The blanket wheel 16 rotates so as to bring the blankets into contact with the inkers to transfer ink onto the blankets. The rotation of the blanket wheel 16 also brings each blanket into contact with a can 18 so as to transfer the ink onto the surface of the can. The cans 18 are transported into and out of contact with the blankets by a conveyor system 20. In the embodiment shown in FIG. 1, there are six inkers 12 which enables up to six different color inks to be used to form the complete indicia which is printed onto the cans 18. Also in the embodiment shown in FIG. 1, the decorator apparatus 10 comprises eight blankets 14. It will be appreciated that the invention is not limited in this regard, and in principle any suitable numbers of inkers and blankets might be utilized.

The design and operation of the blankets, blanket wheel and conveyor can be essentially conventional in nature. Therefore, it is not necessary to provide a further, more detailed discussion of these portions of the decorator apparatus 10. The inkers comprise a print cylinder which is rotated by a print shaft. These aspects of the inkers and described in more detail below. Other features of the inkers, such as the arrangement for applying ink to the print cylinders, are essentially conventional in nature. Therefore, a more detailed discussion of those portions of the inkers is not necessary. The decorator apparatus 10 further comprises a camera 22 and a controller device 24.

Figure 2A:
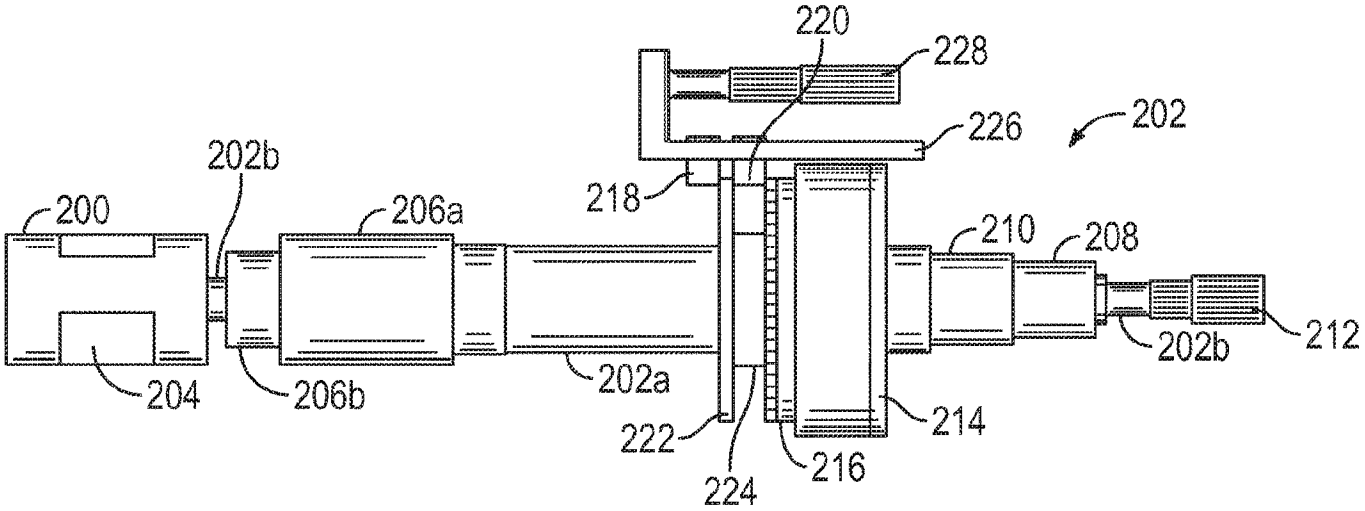
FIG. 2 shows (a) a side view and (b) a cross sectional side view of a print cylinder and print shaft of the invention.
Figure 2B:
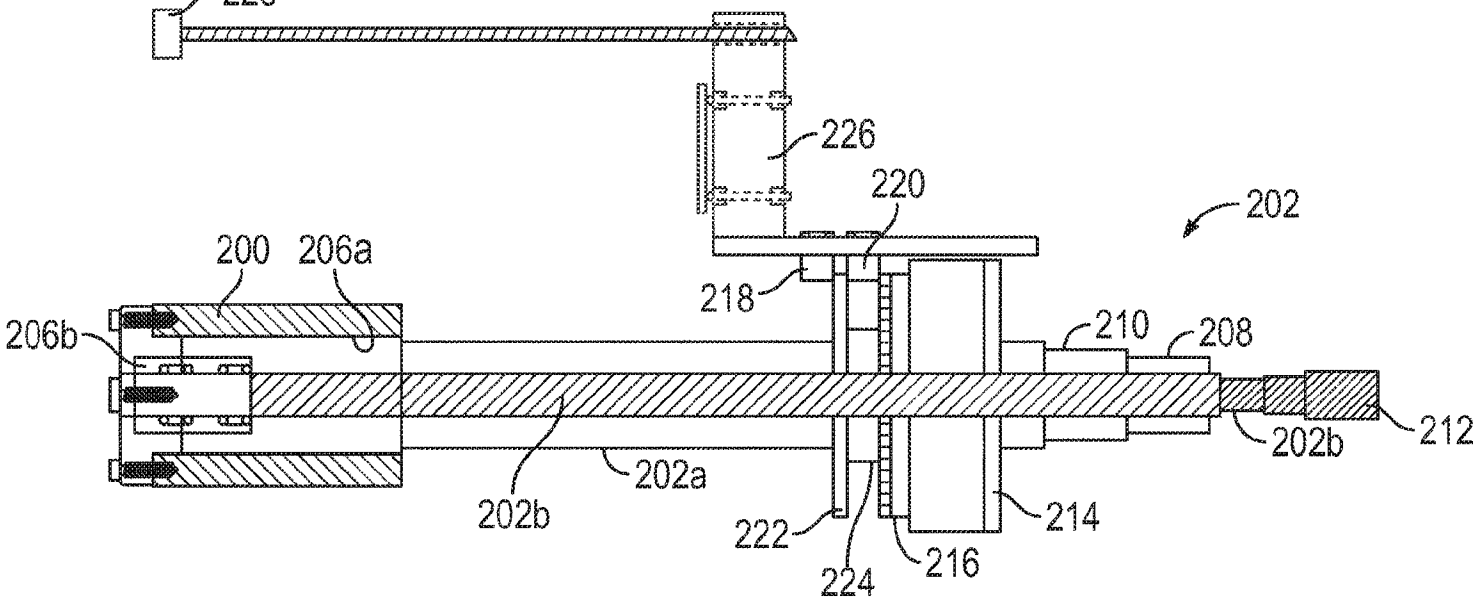

FIG. 2 shows the printer cylinder 200 and print shaft 202 of the inkers 12. The print cylinder 200 has a print plate 204 disposed thereon. The print cylinder 200 is magnetic and the print plate 204 is formed from a metal so that the print plate 204 is retained in place. The print plate 204 has raised features which correspond to the print pattern for the ink color which is applied by the particular inker which the print cylinder 200 is associated with. The print shaft 202 comprises an outer print shaft 202*a* and an inner print shaft 202*b*. The outer print shaft 202*b* has a print cylinder contacting portions 206*a*, 206*b* formed towards one end of the print shaft 202. The print cylinder contacting portion 206*a* can be in the form of a cylinder of larger diameter than the diameter of the outer print shaft 202*a*. Towards the end of the print shaft which is opposite to the end having the print cylinder contacting portion 206*a*, the outer print shaft 202*a* comprises bearing seats 208, 210. The bearing seats 208, 210 house bearings (not shown) which surround the inner print shaft 202*b*.

The end of the inner print shaft 202*b* distal from the print cylinder 200 is connected to a first servomotor 212. The first servomotor 212 is a linear servomotor, and in this way, it is possible to adjust the longitudinal position of the inner print shaft 202*b*. As shown in FIG. 2(*b*), the other end of the inner print shaft 202*b* is connected to the print cylinder 200. The print cylinder 200 is sized so as to be slideable over the surface of the print cylinder contacting portion 206*a*. It will be appreciated by the skilled reader that, in this way, the first servomotor 212 is able to adjust the longitudinal position of the print cylinder 200. The longitudinal axis corresponds to the rotational axis of the print cylinder, and in practice it is longitudinal. The print cylinder contacting portion 206*b* also contacts part of the print cylinder 200.

The print shaft further comprises a backslash gear 214 which is carried by a hub 216. The backslash gear 214 is driven by a bull gear (not shown) which forms part of a conventional decorator apparatus drive mechanism. Cam followers 218, 220 follow a cam 222. The cam 222 is connected to the hub 216 by a connection member 224. The hub 216 is able to move longitudinally along the outer print shaft 202*a*. A key (not shown) underneath the hub 216 permits this longitudinal movement with respect to the outer print shaft 202*a*. The cam followers 218, 220 are mounted on a mounting piece 226. The mounting piece 226 is connected to a second servomotor 228. The second servomotor 228 is a linear servomotor. The second servomotor 228 can be controlled so as to move the mounting piece 226 which in turn moves the cam followers 218, 220. It will be appreciated that the effect of this controlled movement is to adjust the longitudinal position of the hub 216 with respect to the outer print shaft 202*a*. This also adjusts the longitudinal position of the backslash gear 214. The backslash gear 214 carries gear teeth which are inclined at an angle with respect to the longitudinal axis of the print shaft 202. It will be appreciated that longitudinal adjustment of the position of the backslash gear 216 thereby results in a rotational adjustment of the print cylinder 200. In this way, the angular orientation of the print cylinder 200 can be controlled.

Referring back to FIG. 1, the camera 22 is positioned to monitor the blankets 14 after ink has been transferred to them from the inkers 12 but before printing onto the cans 18 takes place. The camera is used to detect any misregistration of one of more of the differently colored inks which are applied to the blankets. Images obtained by the camera 22, or related data, are input to a controller device 24. A plurality of cameras may be used instead of a single camera, and this can enable better three-dimensional images to be obtained. The controller device 24 has a graphical interface 24*a* which in one possible mode of operation enables a user to make corrections manually. However, in another mode of operation the invention provides an automatic correction of any misregistration of the inks applied by one of more of the inkers 12. The controller device 24 utilizes a suitable computer program which examines the images obtained by the camera 22, and recognizes any misregistration. The controller device 24 and its computer program is also adapted to provide suitable control signals to one or both of the first and the second servomotors of an inker 12 in order to correct the detected misregistration. For example, if a misregistration was detected and it was identified that the cause was that the image applied to the blanket by inker 12*a* was too high, then the longitudinal position of the print cylinder used in inker 12*a* would be lowered in order to correct this misregistration. This would be done by controlling the first servomotor associated with print cylinder of inker 12*a* so as to retract the inner print shaft within the outer print shaft. This has the effect of lowering the print cylinder. Another type of misregistration occurs when one of the ink colors is applied too far to the left or right of a blanket. In this instance, the controller device 24 identifies which inker 12 is responsible for the misregistration and controls the second servomotor associated with this inker device to adjust the position of the cam followers with respect to the longitudinal axis of the print shaft. In this way the position of the backslash gear is adjusted to so as to move the print cylinder clockwise or counter clockwise as required. In this way, the angular orientation of the print cylinder is adjusted so as to correct the misregistration. It will appreciated that if the controller device detects that a number of inks are being applied out of register, then appropriate correction of a plurality of inkers will occur. The detection of the misregistrations and the appropriate adjustment of one or more servomotors to correct the misregistration can be performed in a number of ways. For example, look up tables or algorithms might be used. Another alternative is to utilize artificial intelligence.

Although in the arrangement of FIG. 1 the camera 22 monitors the blankets, other variations are possible. For example, the camera may take images of the cans after printing has taken place. Another possibility is for the camera to examine marks on the print plates. In this instance, the print plates may each comprise a suitable registration mark such as a dot, line or cross. The blankets have corresponding registration features. For example, if a blanket receives six different colors from six different inkers, and the print plate of each inker has a dot as a registration mark, the blankets will have six spaced apart dots, one for each color. Advantageously, the dots may be located in an outer region of the blanket, for example close to the edge. If there is a misregistration in the printing of one of the colors, then this will be visible as a misregistration between a registration mark on a print blanket and the corresponding mark printed by the relevant print plate. This can be readily detected and appropriate correction may by adjusting the longitudinal position and/or the angular orientation of the relevant print cylinder.

Figure 3:
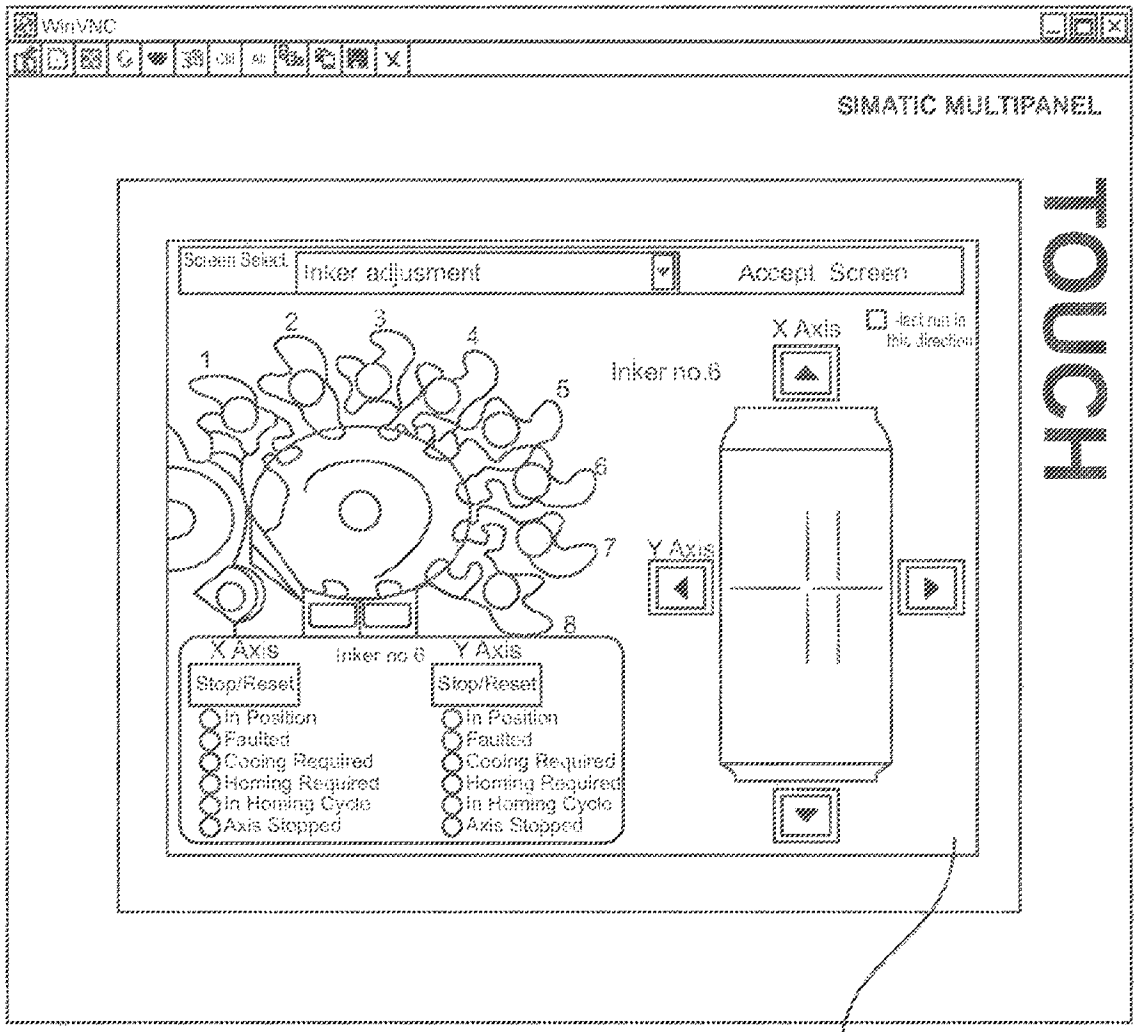
FIG. 3 shows a graphical interface for use by a user.

FIG. 3 shows a graphical interface 300 which might be used in conjunction with the invention. The graphical interface 300 is in the form of a touch screen. The touch screen can be used in a manual adjustment mode, where adjustments to the registration are made by a user. The adjustments made by the user result in appropriate control of the servomotors of one or more of the inkers.

The correction of misregistration provided by the invention has numerous advantages. It is possible to quickly correct misregistration without stopping the decorator apparatus. Rapid detection of any misregistration reduces spoilage caused by misprinting onto cans. If the camera is set up so as to detect misregistration on the blankets (or the print cylinders) then it is possible to detect misregistrations without any spoilage, because misregistration can be detected without printing on the cans. This mode might be employed as part of startup routine, or to make spot checks on registration as part of a manual correction mode.

Other forms of servomotor control of the print cylinder can be used. For example, the actuator system disclosed in U.S. Pat. No. 5,235,911, the entire contents of which are herein incorporated by reference, might be used or adapted for use as part of the misregistration correction methodology provided by the invention. However, it is believed that the servomotor control system described in relation to FIGS. 1 and 2 provides numerous advantages. It is particularly applicable to decorators of the Rutherford type, and in fact it can be retrofitted to existing Rutherford inkers quite easily. The inner print shaft can be provided by drilling a hole through the center of a standard Rutherford print shaft, and inserting the inner print shaft. This servomotor has a low number of wear parts, and it is space efficient. All of the adjustment components are internal to the inker cylinder, which makes maintenance easier. Also, if it is necessary to remove an inker for maintenance purposes, then it is possible to continue printing onto cans using the inkers. Runs can be made either using one color fewer, or a substitute inker could be inserted. In this way, maintenance can be performed without having to stop operation of the decorator apparatus.

What is claimed is:

1. An apparatus for printing onto cylindrical structures comprising:

a plurality of inker devices each comprising a print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon;

a transporter for transporting the cylindrical structures into and out of contact with the print blankets, wherein each inker device comprises one or more servomotors for adjustably controlling the position or orientation of a print cylinder; and an automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device, in which the print inspection device inspects the print blankets to detect the misregistration.

2. The apparatus according to claim 1 wherein the print inspection device comprises a camera.

3. The apparatus according to claim 1 wherein the print cylinders each have a longitudinal adjustment servomotor which adjustably controls a longitudinal position of its respective cylinder, wherein the longitudinal adjustment servomotors are controlled by the controller.

4. The apparatus according to claim 3 wherein the print cylinders are each connected to their respective longitudinal adjustment servomotor through a print shaft, wherein at least a portion of the print shaft is moveable by the longitudinal adjustment servomotor so as to adjustably control the longitudinal position of its respective print cylinder.

5. The apparatus according to claim 4 wherein the print shafts each comprise an outer shaft member and an inner shaft member which is reciprocable within the outer shaft member, in which the inner shaft member is connected to its respective longitudinal adjustment servomotor and print cylinder so that the longitudinal adjustment servomotor can adjust the longitudinal position of the print cylinder by moving the inner shaft member.

6. The apparatus according to claim 1 in which the print cylinders each have an angular adjustment servomotor which adjustably controls the angular orientation of its respective print cylinder about a rotational axis, wherein the angular adjustment servomotors are controlled by the controller.

7. The apparatus according to claim 6 further comprising a drive mechanism, wherein the print cylinders are each connected to a print shaft which carries a gear, the gear being driven by the drive mechanism to cause the print cylinder to rotate about the rotational axis, wherein the angular adjustment servomotor is arranged to alter the operation of the gear so as to adjustably control the angular orientation of its respective print cylinder.

8. The apparatus according to claim 7 wherein each gear is slideable along the print shaft under the control of the angular adjustment servomotor.

9. The apparatus according to claim 8 wherein each angular adjustment servomotor is connected to one or more cam followers which follow a cam, where the cam is disposed on the print shaft and forms part of or is connected to a hub which is slideable along the print shaft and on which the gear is mounted.

10. The apparatus according to claim 1 for printing onto cans in which the transporter is configured to transport a plurality of cans into and out of contact with the print blankets.

11. An apparatus for printing onto cylindrical structures comprising:

a plurality of inker devices each comprising a print cylinder;

a blanket device comprising a plurality of print blankets, in which the blanket device is configured to bring each print blanket into contact with the print cylinders to transfer ink from the print cylinders to the print blanket, and to bring each print blanket into contact with a cylindrical structure to achieve printing thereon;

a transporter for transporting the cylindrical structures into and out of contact with the print blankets, wherein each inker device comprises one or more servomotors for adjustably controlling the position or orientation of a print cylinder; and an automatic print correction system comprising a print inspection device for detecting a misregistration of ink transferred from one or more of the print cylinders onto a print blanket, and a controller for controlling the servomotors of the print cylinders to correct the misregistration in response to data received from the print inspection device, wherein the print cylinders each have a longitudinal adjustment servomotor which adjustably controls a longitudinal position of its respective cylinder, wherein the longitudinal adjustment servomotors are controlled by the controller; and the print cylinders are each connected to their respective longitudinal adjustment servomotor through a print shaft, wherein at least a portion of the print shaft is moveable by the longitudinal adjustment servomotor so as to adjustably control the longitudinal position of its respective print cylinder, and wherein the print shafts each comprise an outer shaft member and an inner shaft member which is reciprocable within the outer shaft member, in which the inner shaft member is connected to its respective longitudinal adjustment servomotor and print cylinder so that the longitudinal adjustment servomotor can adjust the longitudinal position of the print cylinder by moving the inner shaft member.

12. The apparatus according to claim 11 wherein the print inspection device inspects the print blankets to detect a misregistration.

13. The apparatus according to claim 11 wherein the print inspection device inspects the printed cylindrical structures to detect a misregistration.

14. The apparatus according to claim 11 wherein the print inspection device comprises a camera.

15. The apparatus according to claim 11 wherein the print cylinders each have an angular adjustment servomotor which adjustably controls the angular orientation of its respective print cylinder about a rotational axis, wherein the angular adjustment servomotors are controlled by the controller.

16. The apparatus according to claim 15 further comprising a drive mechanism, wherein the print cylinders are each connected to a print shaft which carries a gear, the gear being driven by the drive mechanism to cause the print cylinder to rotate about the rotational axis, wherein the angular adjustment servomotor is arranged to alter the operation of the gear so as to adjustably control the angular orientation of its respective print cylinder.

17. The apparatus according to claim 16 wherein each gear is slideable along the print shaft under the control of the angular adjustment servomotor.

18. The apparatus according to claim 17 wherein each angular adjustment servomotor is connected to one or more cam followers which follow a cam, wherein the cam is disposed on the print shaft and forms part of or is connected to a hub which is slideable along the print shaft and on which the gear is mounted.

19. The apparatus according to claim 15 wherein the transporter is configured to transport a plurality of cans into and out of contact with the print blankets.

20. A method of printing onto cylindrical structures comprising the steps of:

operating a plurality of inker devices to apply ink to a plurality of print cylinders, each inker device having one or more servomotors for adjustably controlling the position or orientation of its print cylinder;

operating a blanket device comprising a plurality of print blankets, transferring ink from the print cylinders to the print blanket and transferring ink from the print blanket to a cylindrical structure to achieve printing thereon; and automatically detecting a misregistration of ink transferred from one or more of the print cylinders onto the print blanket with a print inspection device that inspects the print blankets to detect a misregistration and automatically controlling the servomotors of the print cylinders to correct the misregistration in response to the detection of a misregistration.

* * * * *